US008418404B2

(12) United States Patent
Gramstad et al.

(10) Patent No.: US 8,418,404 B2
(45) Date of Patent: Apr. 16, 2013

(54) WINDOW WITH OPENING CONTROL MECHANISM

(75) Inventors: Derek Gramstad, Owatonna, MN (US); David Runk, Hudson, WI (US); Steven Peterson, Hudson, WI (US)

(73) Assignee: Andersen Corporation, Bayport, MN (US)

( * ) Notice: Subject to any disclaimer, the term of this patent is extended or adjusted under 35 U.S.C. 154(b) by 34 days.

(21) Appl. No.: 13/210,583

(22) Filed: Aug. 16, 2011

(65) Prior Publication Data

US 2012/0036781 A1 Feb. 16, 2012

Related U.S. Application Data

(60) Provisional application No. 61/373,992, filed on Aug. 16, 2010.

(51) Int. Cl.
*E06B 3/50* (2006.01)
*E05D 15/16* (2006.01)

(52) U.S. Cl.
USPC ..... 49/141

(58) Field of Classification Search ..... 49/141, 49/246; 16/260, 270
See application file for complete search history.

(56) References Cited

U.S. PATENT DOCUMENTS

| | | | | | |
|---|---|---|---|---|---|
| 2,175,861 | A | * | 10/1939 | Wall | 49/261 |
| 2,760,805 | A | * | 8/1956 | Stevens et al. | 49/356 |
| 2,811,349 | A | * | 10/1957 | Bondurant et al. | 49/324 |
| 2,863,182 | A | * | 12/1958 | Gabor | 49/261 |
| 3,509,663 | A | * | 5/1970 | Miller | 49/248 |
| 4,254,583 | A | * | 3/1981 | Smits et al. | 49/246 |
| 5,052,079 | A | * | 10/1991 | Vosskotter | 16/367 |
| 5,081,741 | A | * | 1/1992 | Aumercier | 16/238 |
| 5,802,768 | A | * | 9/1998 | Hammer et al. | 49/325 |
| 2004/0128914 | A1 | * | 7/2004 | Hempelmann | 49/192 |
| 2011/0203184 | A1 | * | 8/2011 | Nguyen et al. | 49/400 |

FOREIGN PATENT DOCUMENTS

| | | | |
|---|---|---|---|
| GB | 2249128 A | * | 4/1992 |
| GB | 2259947 | * | 3/1993 |
| GB | 2287062 | * | 9/1995 |

(Continued)

*Primary Examiner* — Jerry Redman
(74) *Attorney, Agent, or Firm* — Womble Carlyle Sandridge & Rice, LLP

(57) ABSTRACT

A window, which may be a casement window, includes an opening control mechanism for limiting the amount that the sash of the window can be opened to control ventilation and as a child safety feature. In one configuration, the opening control mechanism includes a frame track and release assembly attached to the window frame and a sash arm assembly including an articulating sash arm attached to the sash of the window. The frame track and release assembly has a track and a roller on one end of the sash arm rides along the track as the window sash begins to open. At the end of the track, the roller engages and is restrained by a release arm or stop thereby preventing the sash from being opened further. A lever or a button operatively coupled to the release arm is disposed inside the dwelling and inside an insect screen of the window. The lever can be slid sideways and then pulled back in two distinct motions to release the roller to allow the sash to be opened beyond its restrained position. The button can be exposed by moving a hingable cover from over the button and the button pressed to release the roller. The sash arm and track re-engage automatically when the window sash is closed.

26 Claims, 9 Drawing Sheets

FOREIGN PATENT DOCUMENTS

| | | | |
|---|---|---|---|
| GB | 2304808 | * | 3/1997 |
| GB | 2307944 | * | 6/1997 |
| GB | 2325022 | * | 11/1998 |
| GB | 2399859 | * | 9/2004 |
| JP | 2005139852 | * | 6/2005 |
| WO | 2005052295 | * | 6/2005 |

* cited by examiner

WINDOW WITH OPENING CONTROL MECHANISM

REFERENCE TO RELATED APPLICATION

Priority is hereby claimed to the filing date of U.S. provisional patent application Ser. No. 61/373,992 filed on Aug. 16, 2010.

TECHNICAL FIELD

This disclosure relates generally to windows and more specifically to devices for limiting or controlling the degree to which windows such as casement and awning style windows can be opened.

BACKGROUND

In certain types of windows, including casement and awning windows, it is desirable to incorporate a mechanism to limit the amount that the window sash can be opened. This is both for safety reasons and to limit, in certain circumstances, the ventilation flow through the window. It also is desirable to be able to bypass the mechanism when desired to allow the window sash to be opened fully. Recent ASTM standards (ASTM F2090-8 and -10 for example) require that such mechanisms incorporate a "dual action release" for bypassing the mechanism to allow the window sash to be opened beyond its limited amount. A dual action release requires two distinct motions to release the limiting mechanisms, which serves as a child safety feature since small children are less likely to be able to bypass the limiting mechanism. In some jurisdictions, windows that comply with these standards are allowed as code compliant child safety devices. In any case, features that inhibit full opening of the window sash by small children help to protect children from falling out of a window and thus can save precious lives.

At least one commercial casement/awning window offers an opening control mechanism that attempts to meet the ASTM standard mentioned above. However, the mechanism of this product is cumbersome to release when it is desired to open the window beyond its limited amount at least in part because the window screen, which resides on the inside of a casement or awning window, must be removed to access the release mechanism. The screen must be removed again to re-engage the opening control mechanism. In addition, the mechanism of this existing device mounts to the side jamb of the window, which can impede egress through the window in the event of an emergency.

A need exists for a window having an opening control mechanism, particularly for use with casement and awning windows, that effectively limits the amount that the window sash can be opened, that meets ASTM standards for child safety, that can be released and re-engaged without the need to remove an insect screen from the window, and that does not significantly impede egress through the window in an emergency. It is to the provision of such a window and such an opening control mechanism that the present disclosure id primarily directed.

SUMMARY

U.S. provisional patent application Ser. No. 61/373,992, to which priority is claimed above, is hereby incorporated by reference in its entirety.

Briefly described, a window, which in the preferred and illustrated embodiment is a casement window, has a window frame with side jambs, a header, and a sill. A sash is mounted in the window frame and, in the case of a casement window, is hingedly attached to one of the side jambs of the frame. The sash can be opened and closed with a known operator mechanism such as, for instance, a crank having a handle that is rotated by a user for progressively pivoting the sash between open and closed positions. An opening control mechanism is mounted within the window sill and to the sash and, in normal operation, is mostly hidden beneath the sill stop of the window. The mechanism includes a frame track and release assembly mounted to the sill and a sash arm assembly having a pivoting sash arm mounted to the window sash opposing the frame track and release assembly. The sash arm is extendable against the bias of an internal spring from a shortened configuration to a lengthened configuration.

The sash arm includes a depending roller on its free end that rides along a track of the frame track and release assembly as the window sash is cranked open. When the roller reaches the end of the track, it is stopped by a release arm and prevented from further movement. As the sash is cranked open further, the sash arm extends against the bias of its spring to its lengthened configuration, at which time further opening of the sash is prevented by the sash arm. Thus, the amount that the sash can be opened is controlled and limited by the opening control mechanism.

A button is coupled to the release arm and protrudes from beneath the sill stop on the inside of the window and on the inside of a screen mounted in the window. When it is desired to bypass the opening control mechanism and open the window sash further than its limited amount, two distinct actions moves the release arm away from the end of the track releasing the roller of the sash arm from the track to decouple the sash arm from the frame track and release assembly. In one embodiment, the distinct actions include a lateral sliding motion followed by a separate pulling motion. In another embodiment, the two distinct motions include hinging a cover away from the button and pressing the button to release the roller from the track. When this happens, the sash arm pivots under the influence of a spring to a rest position extending along and closely adjacent the sash frame. A user can then crank the window sash open beyond its limited amount to allow additional ventilation or to permit egress if necessary. When the window sash is closed, the roller of the sash arm snaps back into the track at the end opposite the release arm and thus returns to its operable configuration for limiting the amount that the sash can be opened.

Thus, a window is now provided that incorporates an opening control mechanism that is mostly hidden during use, that effectively limits the amount that the window sash can be opened, that can be released for opening the sash further when desired and that re-engages automatically when the sash is closed, all without removing the insect screen of the window, and that meets ASTM safety standards by requiring two distinct motions for bypassing the mechanism to allow the window sash to be opened beyond its limited amount. These and other aspects, features, and advantages of the window of this disclosure will be better appreciated upon review of the detailed description set forth below in conjunction with the accompanying drawing figures, which are briefly describe as follows.

DETAILED DESCRIPTION

Figure 1:
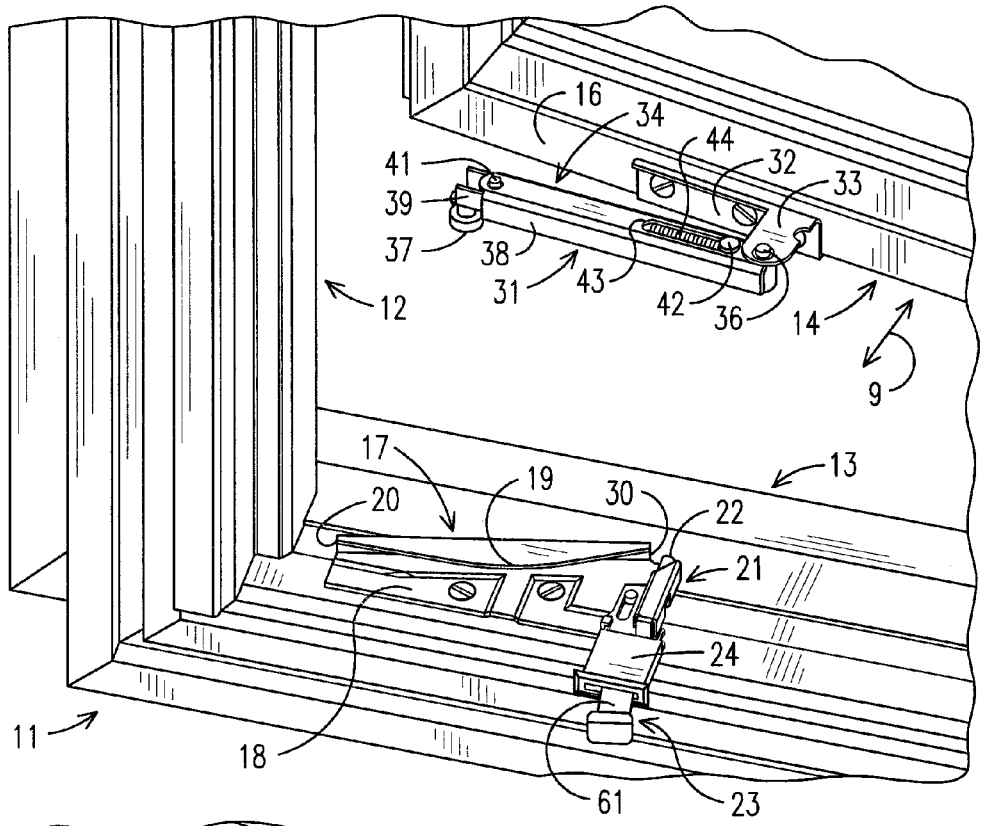
FIG. 1 is a perspective view of a portion of a casement window with stop removed and illustrating one embodiment of a window opening control mechanism.

Referring now in more detail to the drawing figures, wherein like reference numerals indicate like parts throughout the several views, FIG. 1 illustrates a portion (the lower left corner) of a window, which in this case is a casement window, and which embodies principles of the invention. The window 11 has vertical jambs 12 (only one of which is visible), a header (not visible), and a sill 13. A window sash 14 is hingedly mounted in the window frame in such a way that it can swing between open and closed positions as indicated by arrows 9. The sash frame includes a bottom rail 16. An operator such as a crank mechanism, not shown, is provided in the window frame and can be rotated or otherwise operated by a user to open and close the window sash in a known manner.

The window 11 is provided with an opening control mechanism according to one embodiment of the invention for selectively limiting the amount that the sash can be opened. The opening control mechanism includes a frame track and release assembly 17 that, in this embodiment, is mounted to the sill 13 of the window frame. The frame track and release assembly 17 has a base 18 that is secured to the sill with screws or other appropriate fasteners. A guide track 19 is formed along an outside edge portion of the base 19 and, in this embodiment, has an arcuate cam-like edge as shown. The guide track 19 has an entry end 20 on the left in FIG. 1 and an exit end 30 on the right in FIG. 1. A release mechanism 21 is mounted on the base 18 adjacent the exit end 30 of the guide track and includes an activator in the form, here, of a projection in the form of an articulating spring biased release arm 22 coupled to a lever 61 terminating in a grip 23. The grip 23 can be manipulated by a user to retract the release arm 22 in a manner and for purposes described in more detail below. A decorative bezel may be provided if desired to couple the lever 61 to a sill stop covering the frame track and release assembly and to provide a visually attractive interface.

With continuing reference to FIG. 1, the opening control mechanism further includes a sash arm assembly 31 secured with screws or other appropriate fasteners to the lower rail 16 of the sash 14 opposing the frame track and release assembly 17 as shown. The sash arm assembly includes a base 32 mounted to the sash rail 16 and having a projection 33 extending inwardly from the sash rail. An elongated sash arm 34 is pivotally mounted at one end to the projection 33 by means of a pivot pin 36. An internal torsion spring (not visible) biases the sash arm 34 toward the base 32 and thus toward the lower rail 16 of the sash to a rest position as illustrated in FIG. 1. The sash arm 34 includes an outer sleeve 38 within which an inner sleeve 39 is slidably disposed. A restraining pin 42 is secured to and projects upwardly from the internal end of the inner sleeve 39 and is slidably captured in a slot 43 formed in the outer sleeve. A similar restraining pin 41 is secured adjacent to the end of the outer sleeve and projects downwardly where it too is slidably captured in a similar slot (not visible) in the inner sleeve. Thus, the inner sleeve can slidably extend outwardly from the outer sleeve a distance approximately the same as the lengths of the slots within which the pins are captured. A compression spring 44 is disposed within the sash arm between the sleeves and is normally compressed against the pins 42 and 41. It will be appreciated that the compression spring urges the inner sleeve 39 toward its fully retracted position shown in FIG. 1 and that the sash arm 34 can be extended in length by slidably extending the inner sleeve against the bias of the compression spring. Finally, a roller 37, which may be made of nylon or other appropriate material, is rotatably mounted to the exposed end of the internal sleeve 39 and extends downwardly therefrom. The roller 37 has a smaller diameter shank portion and a larger diameter head portion as shown.

Figure 2:
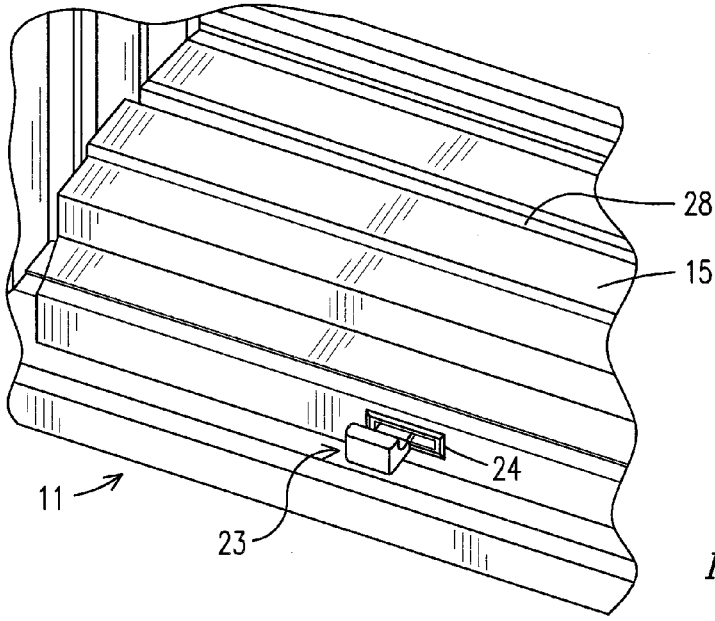
FIG. 2 is a perspective view of a portion of a casement window illustrating the mechanism covered by the sill stop and with the release button protruding from the sill for access.

In FIG. 1, the sash arm assembly is shown disengaged from the frame track and release assembly such that the window opening control mechanism is in a non-functional or bypassed configuration. In this configuration, the window sash can be opened to the full extent allowed by the crank mechanism of the window. However, in its functional configuration, the opening control mechanism limits the amount that the sash can be opened, as described in detail below. FIG. 2 illustrates the window 11 with a traditional sill stop 15 installed on the sash as is known in the art. The sill stop 15 provides a decorative cover, forms a stop against which the sash resides when closed, and, in this case, covers and hides at least a portion of the window opening control mechanism. A screen track 28 is formed in the sill stop for receiving and holding an insect screen on the inside of the sash, which is typical of casement and awning style windows.

Figure 3:
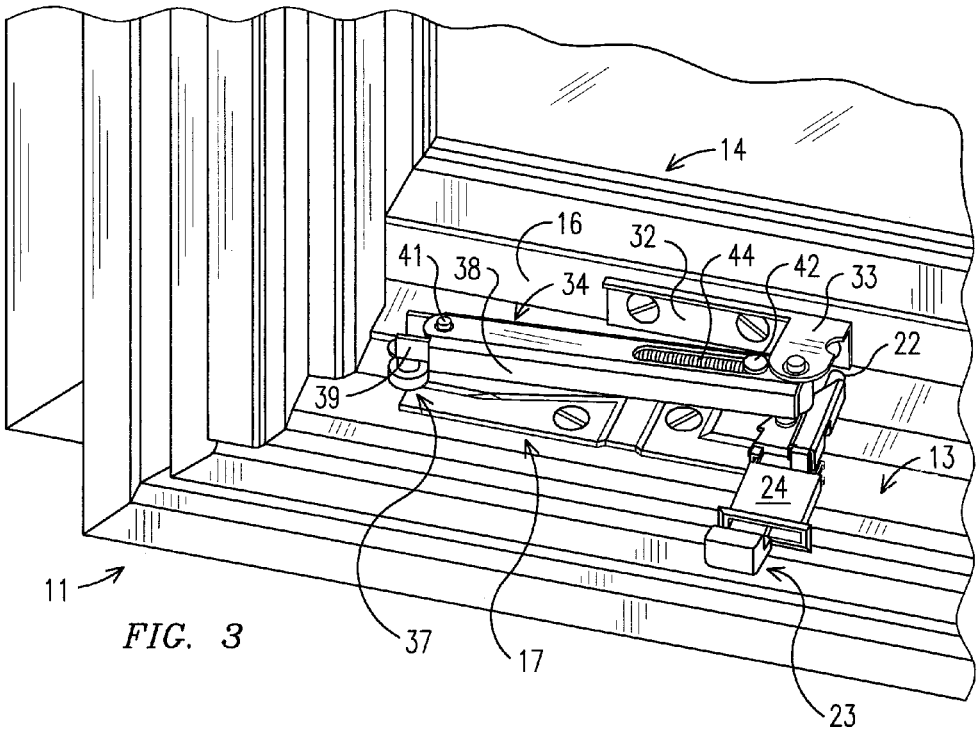
FIG. 3 is a perspective view of a portion of a casement window with stop removed and illustrating the configuration of the opening control mechanism of FIG. 1 when the window sash is closed.
Figure 4:
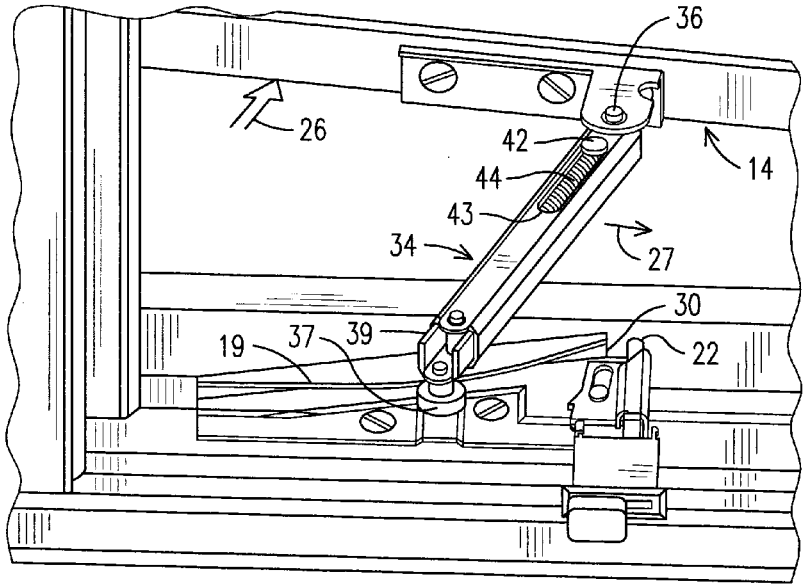
FIG. 4 is a perspective view illustrating the configuration of the opening control mechanism of FIG. 1 with the window sash partially opened.
Figure 5:
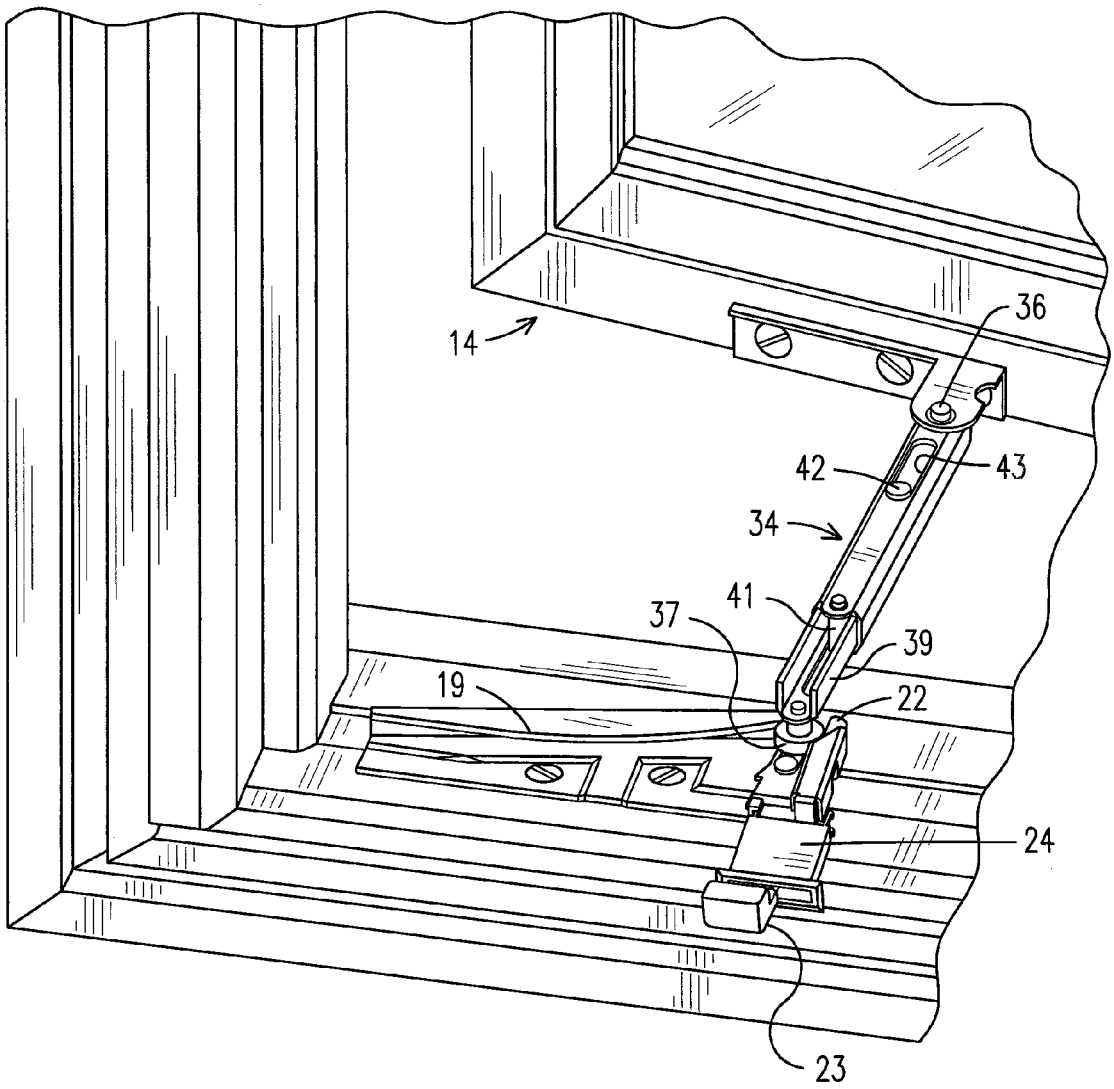
FIG. 5 is a perspective view illustrating the configuration of the opening control mechanism of FIG. 1 with the window sash open to the full extent allowed by the mechanism.

FIGS. 3-5 illustrate operation of the window opening control mechanism of this embodiment to limit the amount that the sash can be opened. FIG. 3 shows the window 11 with its sash 14 closed and the opening control mechanism in its operational configuration. The roller 37 is seen to be engaged with the edge of the track 19 at the entry end 20 of the track and is held there by the tension of the torsion spring (not visible) at the pivoted end of the sash arm. Preferably, the smaller diameter shank of the roller rides on the edge of the track while the larger diameter head of the roller rides beneath the edge of the track. The sash arm also is held in its retracted position by the compression spring 44 and the release arm 22 is in its restraining position adjacent the exit end of the track 19. In FIG. 4, the sash 14 has begun to be opened with the sash hinging outwardly in the direction of arrow 26. As the sash moves outwardly, it pulls the roller 37 to the right along the track 19, causing the sash arm 34 to pivot progressively about pivot pin 36 in the direction of arrow 27. As the roller 37 moves along the track 19, it approaches the exit end 30 of the track 19.

Referring to FIG. 5, as the window sash continues to open, the roller 37 reaches the exit end 30 of the track 19. There, the roller 37 engages the release arm 22, which lodges and retains the roller at the exit end of the track. Further opening of the sash 14 causes the inner portion 39 of the sash arm 34 to be pulled out against the bias of compression spring 44 (FIG. 4) to extend the length of the sash arm until pin 42 engages the end of slot 43 (and/or pin 41 engages the end of its respective slot). At this point, the sash arm is no longer extendable and the window sash is restrained by the sash arm and prevented from opening further. The result is that the amount that the sash can be opened normally is limited to that illustrated in FIG. 5. To close the sash from this position, the crank or other operator is operated in a reverse direction, which causes the sash to close, the sash arm to retract, and the roller to move back along the track 19 to the entry end 20 thereof as shown in FIG. 3. Accordingly, it will be seen that during normal operation, the sash can only be opened a predetermined amount, which can advantageously limit venting through the window and functions as a child safety feature to prevent small children from crawling or falling out of the window.

Figure 6:
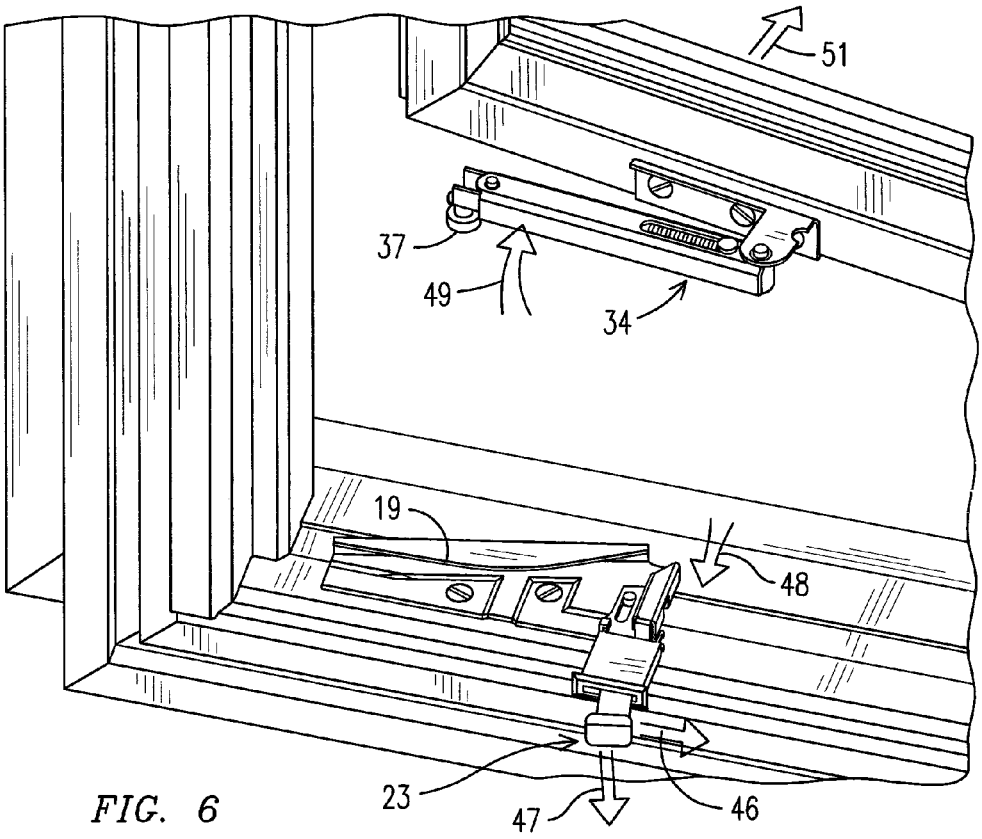
FIG. 6 is a perspective view illustrating the configuration of the opening control mechanism of FIG. 1 as it appears after release of the sash arm to allow the sash to be opened beyond its limited amount.

On occasion, it will be desired to bypass the opening control mechanism in order to open the sash beyond the limited amount shown in FIG. 5. In such event, the opening control mechanism can be bypassed by releasing the sash arm from the frame track and release assembly. More specifically, and with reference to FIG. 6, in order to release the sash arm, a user must carry out two distinct motions or actions. First, in this embodiment, the grip 23 is moved or slid laterally in the direction of arrow 46, which moves the handle 61 laterally as well. Thereafter, the grip (and thus the handle) is pulled outwardly from the sill in direction 47. These two separate actions, the second of which cannot be carried out until the first is completed, cause the release arm 22 to retract, which frees the roller 37 from the exit end of the track 19. As the sash begins to be opened wider, the roller 37 is pulled out of the track 19 to decouple the sash arm from the frame track and release assembly. The sash arm then snaps to its rest position under the influence of its torsion spring as indicated by arrow 49 in FIG. 6 wherein it resides closely adjacent to the sash rail 16. The sash is thus free from restraint and can be opened up to the full extent allowed by the operator mechanism of the window. Further, the rest position of the sash arm adjacent the sash rail minimizes the protrusion of the sash arm into the window opening, thereby reducing the chance that the sash arm might impede egress through the window in the event of an emergency.

Figure 7:
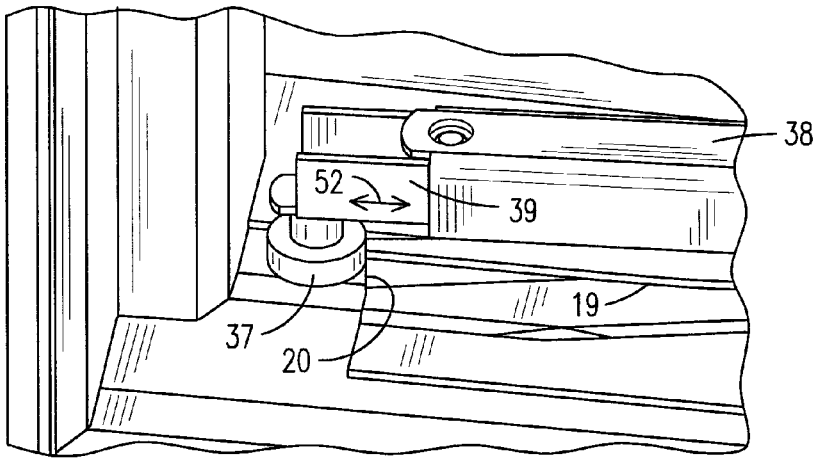
FIG. 7 is a perspective view illustrating the automatic re-engagement of the sash arm with the track of the frame track and release assembly of FIG. 1 when the sash is fully closed after having been opened beyond its limited amount.

After having been opened beyond its restrained position as just described, the opening control mechanism is configured such that the sash arm assembly automatically re-engages with the frame track and release assembly when the sash is closed again. More specifically, and with reference to FIG. 7, as the window sash approaches is fully closed position; the roller 37 engages the entry end 20 of the track 19. Further movement of the sash causes the large diameter portion of the roller 37 to roll over and past the end 20, extending the inner portion 39 of the sash arm slightly against the bias of compression spring 44 (FIG. 3). When the roller moves beyond the end 20, the inner portion 39 of the sash arm snaps back to its fully retracted position under the influence of the compression spring to engage the roller 37 with the track 19. The roller 37 is thus re-engaged with the track and the sash arm re-engaged with the frame track and release assembly such that the window is again configured for limiting the amount the sash can be opened as detailed above.

Figure 8:
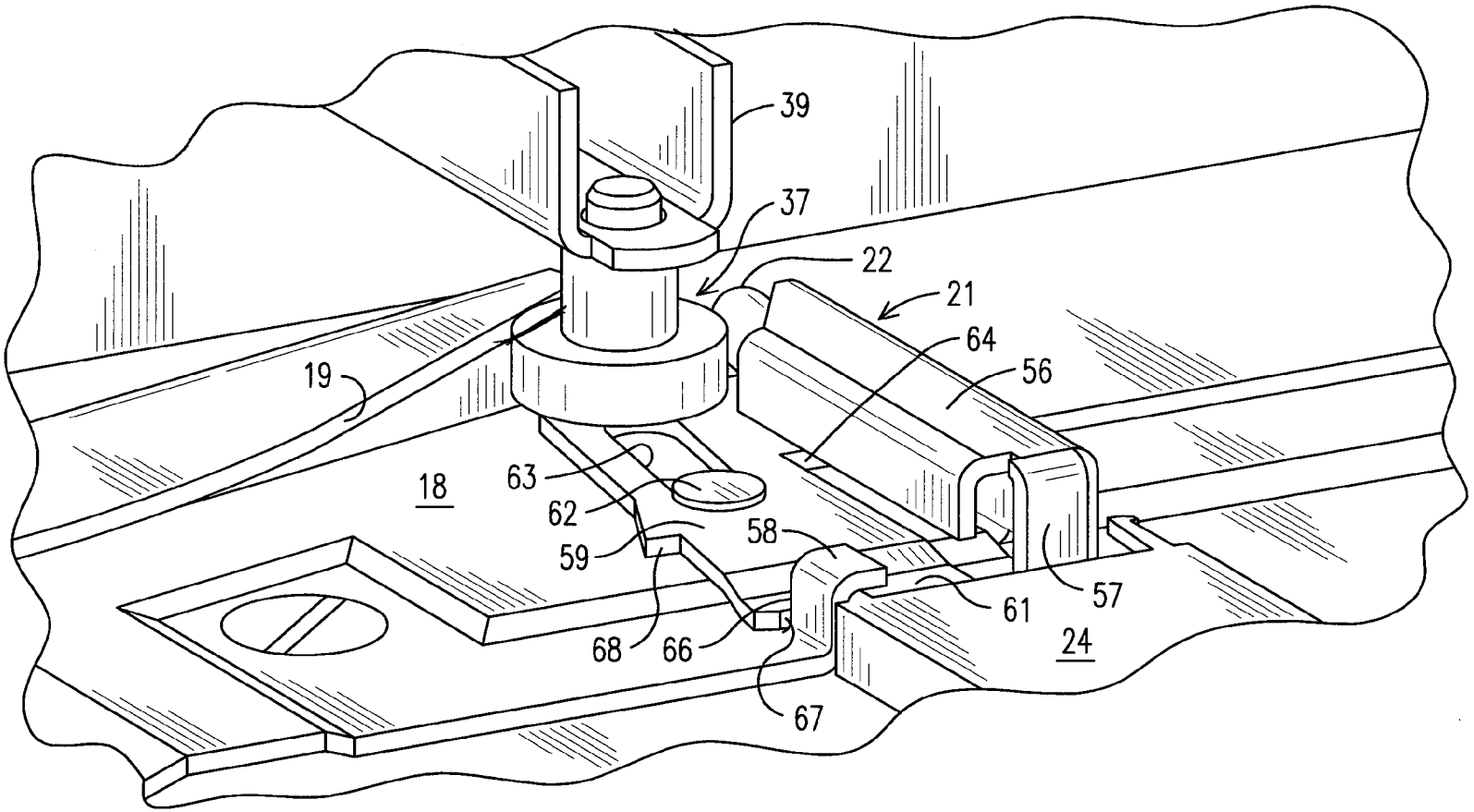
FIG. 8 is an enlarged perspective showing one embodiment of a release mechanism according to the disclosure.
Figure 9:
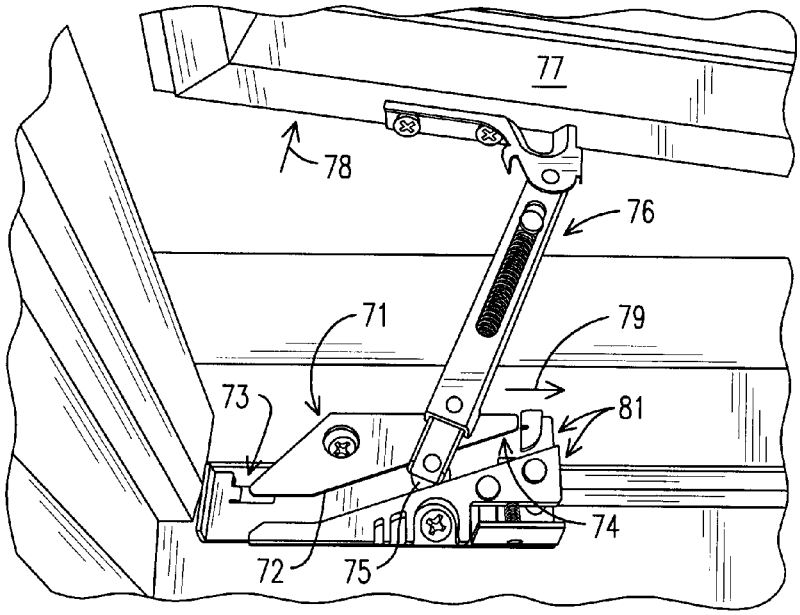
FIG. 9 is a perspective view of another embodiment of a window opening control mechanism.

FIG. 8 is an enlarged perspective of the release mechanism 21 according to the just described embodiment. In this embodiment, the base plate 18 is formed at its end to define a cover 56 with an internal channel, a stop 57 at the back end of the cover 56, and a clip 58. The bottom edge of the clip 58 defines a stop 66. An articulating release plate 59 rests on the base plate 18 and is formed with a handle 61, which extends rearwardly through bezel 24 to grip 23 (FIG. 1). The release plate 59 is formed with a slot 63 and a pin 62 secured to the base plate 18 extends through the slot 63 to a head. The pin 62 is slightly smaller in diameter than the width of the slot so that the slot can slide freely over the pin. The release plate 59 is further formed with a projection 64 that extends beneath an edge of the cover 56 into the channel defined beneath the cover. Within the space, the projection 64 is formed with or otherwise carries the release arm 22 that protrudes from an end of the channel and is engaged by the roller 37 to limit the amount that the sash can be opened as described in detail below.

In FIG. 8, the release mechanism is shown in its rest position with release arm 22 extended to restrain the roller 37 at the end of the track 19. In this position, an edge 67 of the release plate 59 rests against the stop 66 so that the release arm cannot retract and accidentally release the roller. The release plate 59 is urged to and normally held in this rest position by a compression or other appropriate spring (not visible) that resides within the channel of the cover 56. When it is desired to release the sash arm for opening the sash beyond its limited amount, a user first moves the grip 23 to the right (see FIG. 6) against the bias of the spring within the channel. This action moves the edge 67 of the release plate 59 to the right beyond the stop 66 of the clip 58, thus freeing the release plate to move rearwardly. The user then performs the second action of pulling the grip 23 and thus the handle 61 out, causing the release plate to move rearwardly against the bias of the spring until a second edge 68 of the release plate engages the stop 58. As the release plate moves, it is guided by the slot 63 sliding over the pin 62. Movement of the release plate rearwardly also moves the attached release arm 22 rearwardly until the roller 37 is freed from the end of the track 19, thereby decoupling the sash arm from the frame track and release assembly to allow the sash to be opened beyond its limited amount as described above.

With reference to FIG. 2, it will be appreciated in view of the forgoing description that operation of the release mechanism to release the sash arm is carried out without the requirement to remove an insect screen located in the screen slot 28 on the inside of the sash. This is because the grip is located on the inside of the sill and inside the location of the screen. Further, re-engagement of the sash arm with the frame track and release assembly occurs automatically when the sash is closed, again without the need to remove the screen. The two distinct motions required to release the sash arm and allow full opening of the sash meets ASTM standards for child safety features of windows, which protects children and qualifies the window for advantageous certifications in many jurisdictions.

FIGS. 9 through 16 illustrate a window opening control mechanism incorporating a release mechanism of an alternate embodiment. In these figures, the track of the frame track and release assembly and the sash arm assembly, although slightly different in configuration, function essentially as described above. Accordingly, a detailed description of these components and their basic interaction need not be repeated here. Generally, however, the mechanism includes a frame track and release assembly 71 mounted to a window sill and defining a guide track 72 having an entry end 73 and an exit end 74. The frame track and release assembly 71 normally is covered by a stop 101 (FIG. 14), which has been removed in FIGS. 9-13 for clarity. A sash arm assembly 76 is attached to a sash rail 77 and includes a roller 75 that moves to the right along the guide track 72 in the direction of arrow 79 as the window sash is opened in the direction of arrow 78. At the exit end of the track, the roller 75 is engaged by a portion of a release mechanism 81 and prevented from moving out of the track, which, in turn limits the amount that the window sash can be opened. It is the release mechanism 81 that is different in configuration and operation from that of the first described embodiment and thus will be described in more detail.

Figure 10:
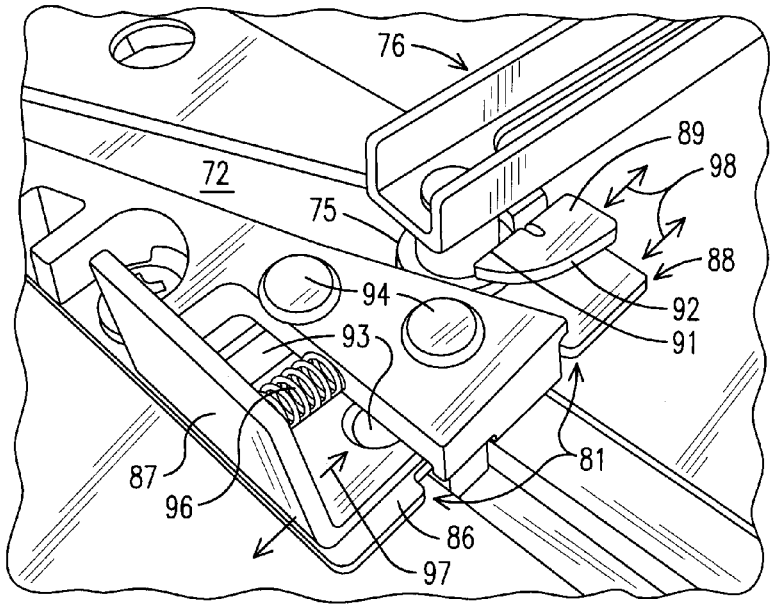
FIG. 10 is an enlarged perspective of the release mechanism of the embodiment of FIG. 9 as it appears when the window sash is opened to the full extent allowed by the mechanism.

Referring to FIG. 10, the release mechanism 81 is disposed adjacent the exit end portion of the track 72 and comprises a metal component bent, in this case, to define a base plate 86, an upturned end 87, and a stop 89. The stop 89 is formed with a restraining edge 91 facing the exit end of the track 72 and an opposite edge 92 that is generally crescent-shaped. The base plate 86 is formed with longitudinal slots 93 within which pins 94 are disposed so that the release mechanism can slide back and forth on the pins 94 in the directions of arrows 97 and 98. A compression spring 96 biases the release mechanism 81 to its normal position shown in FIG. 10. In this position, the restraining edge 91 is disposed in the path of roller 75 at the exit end of the track 72 and thus prevents the roller from exiting the track. This, in turn, prevents the window sash from opening beyond a predetermined amount as detailed above.

Figure 11:
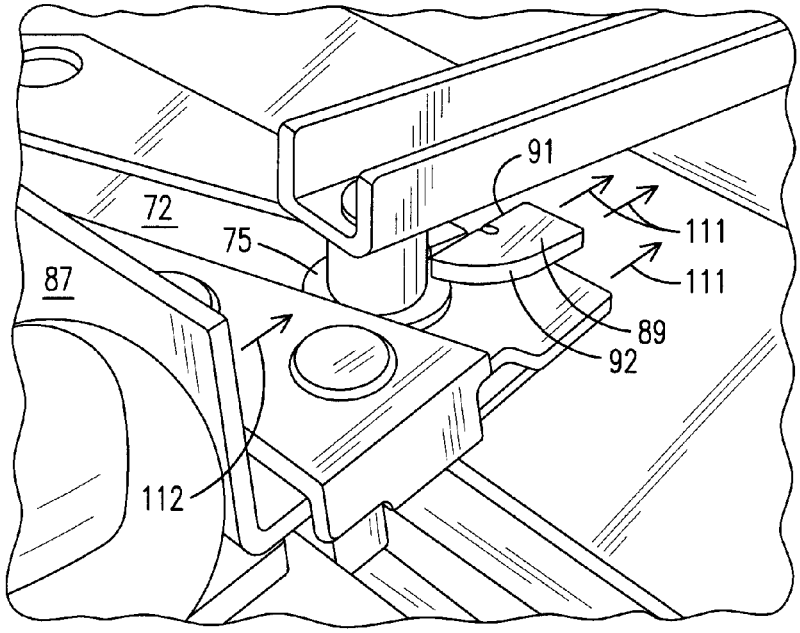
FIG. 11 is an enlarged perspective illustrating displacement of the release mechanism of FIG. 10 to free the sash arm from the track for opening the window sash.
Figure 12:
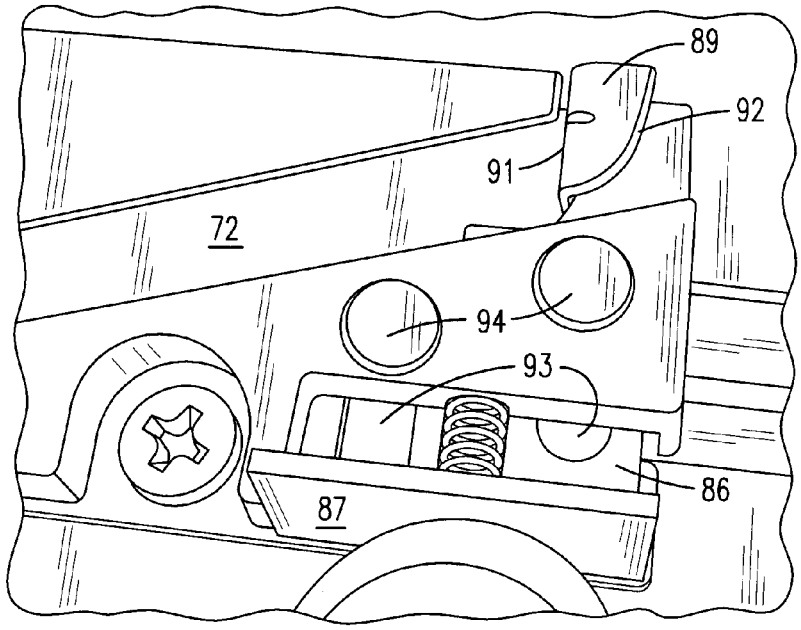
FIG. 12 illustrates the release mechanism of FIG. 11 in its sash arm restraining configuration.
Figure 13:
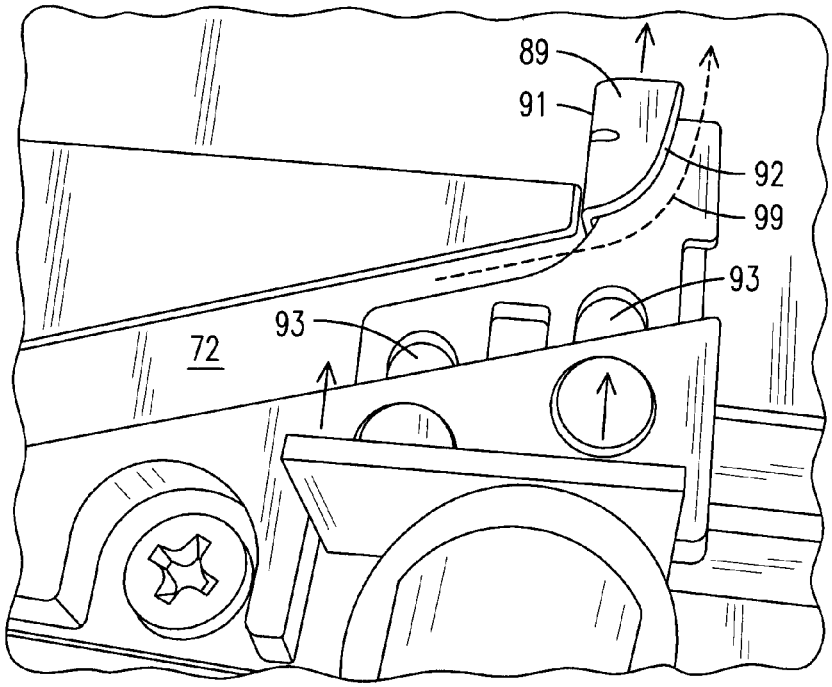
FIG. 13 illustrates the release mechanism of FIG. 11 in its sash arm releasing configuration.

As illustrated in FIG. 11, force applied to the upturned end 87 of the release mechanism in the direction of arrows 112, causes the release mechanism, including its stop 89, to move against the bias of the compression spring in the direction of arrows 111. This, in turn, moves the restraining edge 91 of the stop 89 out of the path of the roller 75 thereby freeing the roller to move beyond the exit end of the slot 72. At this point, the roller 75 moves out of the slot 75, rides along the crescent-shaped edge 92 of the stop 89 and is freed from the slot. A user can then open the sash to the full extent allowed by its operator mechanism. When the sash is closed again, the roller 75 snaps back into the entry end 73 of the track much in the same way as described above relative to the first embodiment. This recaptures the roller of the sash arm in the track. It will thus be seen that pressing the upturned end of the release mechanism releases the sash arm from restraint by the track thus allowing the sash to be fully opened. FIG. 12 perhaps more clearly shows the release mechanism in its retracted restraining position and FIG. 13 shows the release mechanism in its depressed releasing position. FIG. 13 illustrates the restraining edge 91 of the stop moved completely out of the track 72 and shows the path 99 of the roller of the sash arm as it is released from the track 72 and rides over the crescent-shaped surface 92 of the stop 89.

Figure 14:
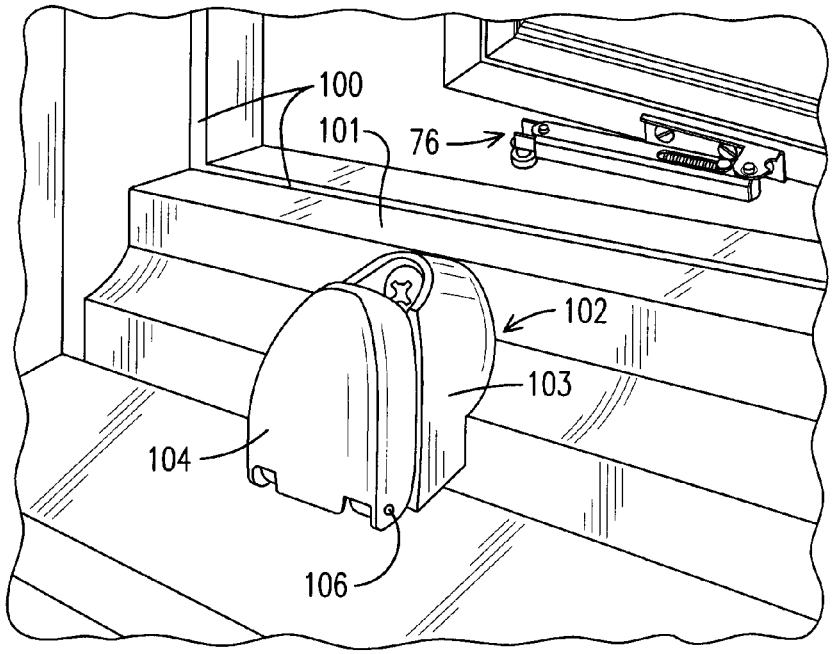
FIG. 14 illustrates another embodiment of a dual action activator for releasing the sash arm from the track.
Figure 15:
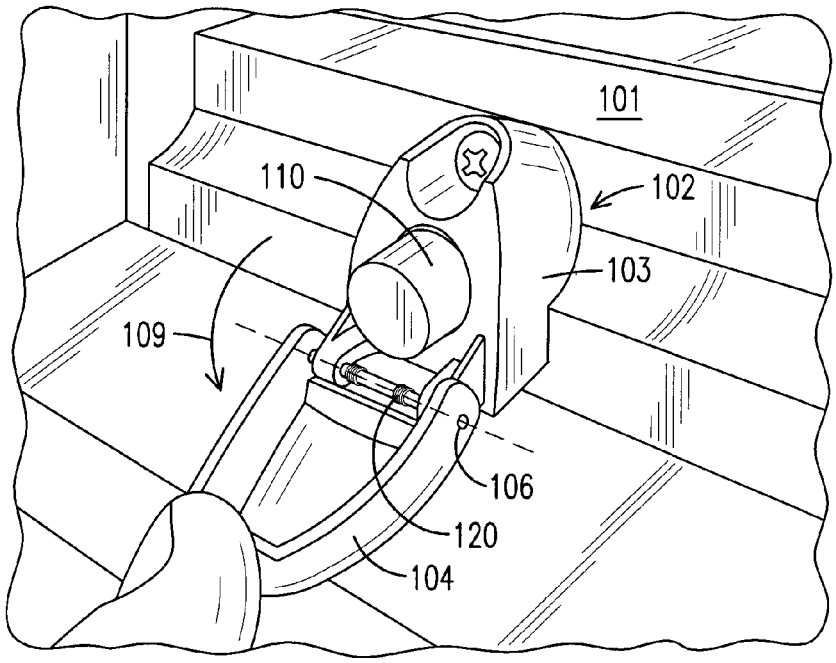
FIG. 15 illustrates the first of two actions required to operate the activator of FIG. 14.
Figure 16:
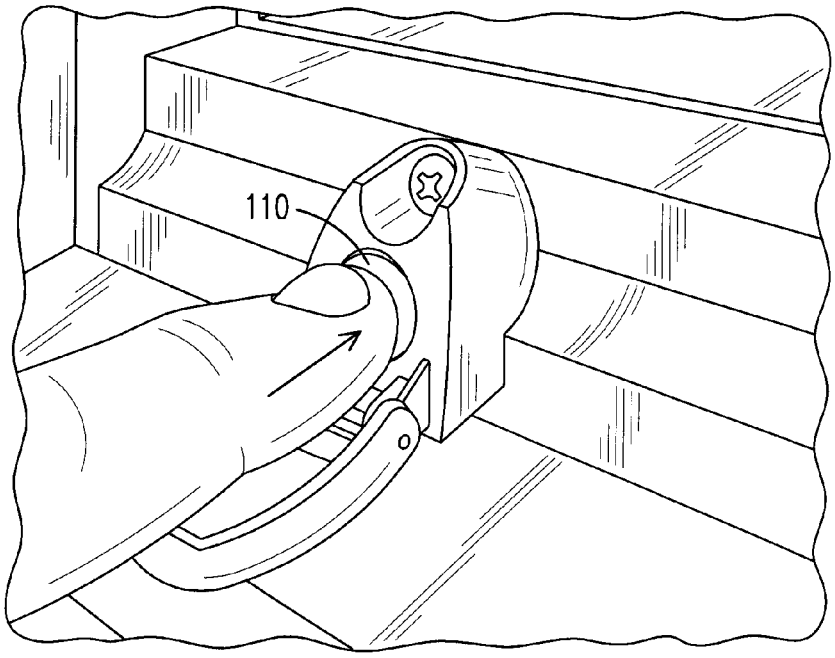
FIG. 16 illustrates the second of two actions required to operate the activator of FIG. 14.

FIGS. 14-16 illustrate an activator in the form, here, of a release trigger for selective manual activation of the release mechanism of the frame track and release assembly 71. In these figures, the frame track and release assembly 71 is covered and hidden by a sill stop 101 installed on the window sash and this is the normal appearance of a window incorporating the present invention. A screen track 100 is configured to receive and hold a screen. In FIG. 14, the sash arm assembly 76 is partially visible attached to the partly opened window sash. A release trigger 102 is attached to the stop 101 with a screw or other appropriate fastener. The release trigger includes a base 103, a partially translucent cover 104 hingedly attached by a hinge pin 106 to the base and biased to a closed position shown in FIG. 14. The cover 104 overlies a projection comprising, here, a button 110 (FIG. 15) that extends through the sill stop 101 to engage with the upturned end 87 of the release mechanism concealed beneath the sill stop. Pressing the button 110 moves the release mechanism to the position shown in FIG. 13 to release the window sash to be fully opened as described above.

FIGS. 15 and 16 illustrate the two distinct actions required to release the sash in this embodiment of the invention. First, as illustrated in FIG. 15, the cover 104 is hinged downwardly about the axis of hinge pin 106 against the bias of a hinge spring 120. This is the first distinct action. Then, as shown in FIG. 16, the button 110 can be pressed inwardly to release the sash arm from its track and thus free the sash to be opened fully. This is the second distinct action. Of course, windows may have sash stops of various and sundry shapes and sizes so that the sash stop configuration shown in FIGS. 14-16 is exemplary only and illustrated only to describe the invention. The same is true of the release trigger configuration, which generally will be shaped and sized to match a particular window to which it is designed to be attached.

The invention has been described herein in terms of preferred embodiments and methodologies considered by the inventors to represent the best mode of carrying out the invention. However, it should be understood that the invention is not limited by the details of the illustrated embodiments, which are presented as examples to enable those of skill in the art to understand and carry out the invention. Many modifications and additions might be made to the illustrated embodiments within the scope of the invention. For instance, while placement of the frame track and release assembly on the sill of a window with the sash arm assembly mounted to the lower rail of the sash frame is illustrated and perhaps preferred, the frame track and release assembly may also be mounted on a jamb of a window with the sash arm assembly mounted to a vertical stile of the window sash. The system may even be mounted at the top of the window to meet application specific requirements if desired.

In the preferred embodiments illustrated in detail above, the frame track and release assembly is mounted to the window frame, preferably the sill, and the sash arm assembly is mounted to the sash frame. While this arrangement has proven successful, it is not a limitation of the invention. The frame track and release assembly may, for example, be mounted to the sash frame with the sash arm assembly mounted to the window frame. Such a configuration is intended to be encompassed within the scope of the invention disclosed herein.

The release mechanism may be located on the opposite end of the track than shown for a left hinged window or for aesthetic purposes. The particular configurations of the release mechanism are not necessarily a limitation of the invention either. While preferred embodiments are shown, the release mechanism may take on any of a variety of configurations so long as it imposes the requirement of two distinct motions; slide-pull, hinge-push, or otherwise, to release the sash arm. The invention has been illustrated in the context of a casement window, but may also be used on any other type of window where appropriate for limiting the amount that the window sash can be opened. While many parts have been illustrated as formed metal parts, they may also be fabricated in a variety of other ways, such as separate components attached together, or of other appropriate materials. These and other additions, deletions, and modifications, both subtle and gross, might well be made by skilled artisans without departing from the spirit and scope of the invention, which is delineated only by the claims.

What is claimed is:

1. A window having an exterior side and an interior side, the window comprising:

a window frame;

a sash mounted in the window frame and being attached to the window frame for hinged movement between a closed position against the window frame and an open position hinged outwardly from the window frame;

the window frame being configured to receive an insect screen;

a frame track and release assembly mounted to the window frame or to the sash;

a sash arm mounted to the window frame if the frame track and release assembly is mounted to the sash or to the sash if the frame track and release assembly is mounted to the window frame, the sash arm opposing the frame track and release assembly when the sash is in its closed position;

the frame track and release assembly restraining an end of the sash arm when the sash is opened a predetermined limited amount to prevent further opening of the sash;

a release mechanism on one of the frame track and release assembly and the sash arm for selectively releasing the end of the sash arm to permit the sash to be opened beyond the predetermined limited amount; and an activator operatively coupled to the release mechanism and located on the interior side of the insect screen when mounted in the window frame, the activator, when manipulated, releasing the sash arm from the frame track and release assembly without requiring the insect screen to be removed.

2. A window as claimed in claim 1 wherein the frame track and release assembly is mounted to the window frame and the sash arm assembly is mounted to the sash.

3. A window as claimed in claim 1, wherein the window frame comprises a sill and wherein the frame track and release assembly is mounted to the sill.

4. A window as claimed in claim 3 wherein the sash comprises a lower rail and wherein the sash arm is mounted to the lower rail.

5. A window as claimed in claim 1 wherein the release mechanism is configured to require at least two manipulations of the activator before releasing the sash arm from the frame track and release assembly.

6. A window as claimed in claim 5 wherein the at least two manipulations comprise a lateral sliding of the activator and a pulling of the activator.

7. A window as claimed in claim 5 wherein the at least two manipulations comprise displacement of a cover and depression of a button exposed by the displaced cover.

8. A window as claimed in claim 1 wherein the frame track and release assembly comprises a track and wherein the sash arm comprises a roller on an end of the sash arm, the roller moving along the track as the sash opens to extend the sash arm.

9. A window as claimed in claim 8 wherein the frame track and release assembly comprises a release mechanism and the track has an entry end and an exit end and wherein the release mechanism is disposed adjacent the exit end of the track.

10. A window as claimed in claim 9 wherein the release mechanism comprises a portion positioned to restrain the roller of the sash arm when the roller reaches the exit end of the track, the portion being moved to free the roller from the track upon manipulation of the activator.

11. A window as claimed in claim 1 wherein the window is a casement window.

12. A window as claimed in claim 1 wherein the sash arm is extendable in length from a retracted configuration to an extended configuration, the sash arm extending when its end is restrained to allow the sash to be opened further until the sash arm reaches its extended position.

13. An opening control mechanism for a window having a frame with an interior side and an exterior side, a screen track on the interior side of the frame, and a sash movable between a closed position against the frame and an open position pivoted outwardly from the frame, the opening control mechanism comprising:

a frame track and release assembly configured to be mounted to the frame or to the sash of the window;

a sash arm assembly configured to be mounted to the frame of the window if the frame track and release assembly is mounted to the sash or to the sash of the window if the frame track and release assembly is mounted to the frame;

a sash arm pivotally mounted to the sash arm assembly and extending to a free end;

the free end of the sash arm being releasably captured by the frame track and release assembly when the sash is opened a predetermined limited amount to prevent further unintended opening of the sash beyond the limited amount; and a release mechanism including a projection operatively coupled thereto that, when the projection is manipulated in a predetermined manner, releases the free end of the sash arm to allow the sash to be opened beyond its predetermined limited amount, the projection being located on an interior side of the screen track to permit manipulation of the projection without removing an insect screen mounted within the screen track.

14. An opening control mechanism as claimed in claim 13 wherein the projection comprises a handle and wherein the release mechanism is configured to require that the handle be moved in at least two distinct ways before the free end of the sash arm is released by the release mechanism.

15. An opening control mechanism as claimed in claim 14 wherein the two distinct ways comprise a lateral movement and a longitudinal movement.

16. An opening control mechanism as claimed in claim 14 wherein the two distinct ways comprise a cover displacement and a depression of a button exposed by the displaced cover.

17. A window having an exterior side and an interior side, the window comprising:

a window frame;

a sash mounted in the window frame and being attached to the window frame for hinged movement between a closed position against the window frame and an open position hinged outwardly from the window frame;

a screen track on the interior side of the window frame for receiving an insect screen;

a frame track and release assembly mounted to the window frame and including a track having an entry end and an exit end and a release mechanism disposed adjacent the exit end of the track;

a sash arm assembly mounted to the sash generally opposing the frame track and release assembly when the sash is in the closed position, the sash arm assembly comprising an arm pivotally mounted with respect to the sash and having a free end bearing a roller sized to ride along the track of the frame track and release assembly;

the sash arm having an active position wherein the roller rides along the track of the frame track to the exit end of the track of the frame track and release assembly as the sash is opened and an inactive position wherein the roller is disengaged from the track of the frame track and release assembly;

the roller engaging the release mechanism upon reaching the exit end of the track of the frame track and release assembly when the sash arm is in the active position to capture the free end of the sash arm and thereby limit the amount that the sash can be opened; and an activator coupled to the release mechanism for selectively releasing the roller from the track of the frame track and release assembly to permit the sash arm to move to the inactive position allowing the window sash to be opened beyond its limited amount;

the activator including a projection accessible from the interior side of the screen track to permit manual operation of the activator from the interior side of the screen track.

18. A window as claimed in claim 17 wherein the projection comprises a handle.

19. A window as claimed in claim 18 wherein the release mechanism is configured to release the roller upon two distinct motions of the handle.

20. A window as claimed in claim 19 wherein the two distinct motions comprise a sliding motion and a pulling motion.

21. A window as claimed in claim 17 wherein the projection comprises a button covered with a displaceable cover.

22. A window as claimed in claim 21 wherein two distinct motions comprising displacement of the cover and depression of the button are required to release the roller from the track.

23. A window having an exterior side and an interior side, the window comprising:

a window frame;

a sash mounted in the window frame and being attached to the window frame for hinged movement between a closed position against the window frame and an open position hinged outwardly from the window frame;

the window frame being configured to define a screen track for receiving an insect screen;

an opening control mechanism mounted to the window frame and to the sash for preventing the window frame from being opened beyond a limited amount when the opening and control mechanism is engaged;

a release assembly for selectively disengaging the opening control mechanism to permit the sash to be opened beyond the limited amount;

the release assembly including a projection located on the interior side of the window, selective manipulation of the projection disengaging the opening control mechanism without removal of the insect screen when received in the screen track.

24. The window of claim 23 wherein the projection comprises a handle.

25. The window of claim 23 wherein the projection comprises a button.

26. The window of claim 25 further comprising a selectively displaceable cover overlying and at least partially covering the button.

* * * * *